United States Patent [19]

Hardison

[11] Patent Number: 4,467,535

[45] Date of Patent: Aug. 28, 1984

[54] LAUNDRY DRIER DIVIDERS

[76] Inventor: Dorothy A. Hardison, 1015 Alden Ct., Toledo, Ohio 43609

[21] Appl. No.: 471,990

[22] Filed: Mar. 4, 1983

[51] Int. Cl.[3] ..... F26B 11/02

[52] U.S. Cl. ..... 34/109; 34/133; 68/143

[58] Field of Search ..... 34/109, 133; 68/143, 68/145

[56] References Cited

U.S. PATENT DOCUMENTS

| | | | |
|---|---|---|---|
| 1,062,946 | 5/1913 | Bahler | 34/109 |
| 1,593,004 | 7/1926 | Allinson | 34/133 |
| 1,882,284 | 10/1932 | Hullings | 68/143 |
| 2,437,169 | 3/1948 | Miller | 68/143 |
| 2,443,419 | 6/1948 | Gould | 34/109 |
| 2,734,368 | 2/1956 | Richardson | 68/143 |

*Primary Examiner*—Larry I. Schwartz
*Assistant Examiner*—David W. Westphal
*Attorney, Agent, or Firm*—Joseph R. Scalzo

[57] ABSTRACT

This invention relates to a foldable, removable drier divider assembly with removable suction cup pieces that can be easily inserted into a household drier and quickly secured in its operating unfolded position to act as a drier drum divider for separating materials or objects during the drying process in order to dry several non-mixable materials or objects in one operation that otherwise would take several drying operations. The drier assembly consists essentially of a rotatable core unit with a plurality of divider fins extending from it whose outer periphery in their open operating position substantially fit and rotate with the interior of the rotating drier drum without rubbing against the stationary portions of the drier interior. The centering and securing means for this removable assembly is accomplished effectively by having the rotatable core unit provided with a central hollow cylindrical opening throughout its length to receive a tubular cylindrical centering rod around which the core unit rotates and adjustable suction cup end pieces screw connected to each end of the cylindrical rod and the suction cup action against the stationary portion of the drier interior opposite the drier door as well as against the inside of the drier door in its closed operating position actually centers and secures the entire assembly during operation by the simple turning adjustment of the adjustable suction cup end pieces to obtain the desired distance between suction cup faces.

10 Claims, 6 Drawing Figures

LAUNDRY DRIER DIVIDERS

DESCRIPTION

There has long been a need in households using automatic clothes driers to have some means for combining several smaller loads of non-mixable clothes in the same drying operation, rather than being required to have additional separate drying operations for each. The economy in time and energy savings alone is obvious.

Until this time, the manufacturers of automatic household driers have not satisfactorily solved this problem. The present invention, however, demonstrates a practical and economical way to solve this problem with existing household driers, by the simple expedient of providing a removable foldable and adjustable fin divider assembly with removable suction cup pieces that can readily and easily be inserted into the drier drum of most if not all presently manufactured household driers to effectively and efficiently as well as economically solve this problem.

This invention relates to a removable foldable drier divider with a plurality of separating fins that can be folded on placing into the drier through the smaller drier door opening and unfolded and expanded to their full operating dimension within the drier drum to act as dividers to compartmentalize the drier drum so that the different smaller loads of wet wash or objects may be dried separately in one drier operation and compartmentalized without contamination or mixing of the types and colors of clothes, materials or objects normally dried separately in several drier operations.

The utility and important novelty of this new and needed drier divider assembly invention resides in great part on the simplicity and certainty of its design and application, the ease with which it can be quickly installed by any person, and the quick centering and safe securing and stabilizing means that permits the dividers to rotate with the drier drum, yet remain secured and centered so as to maintain its proper centered position with certainty and without possible damage or danger to the drier drum, drier door or drier interior. The novelty of invention incorporated herein is one that lends itself admirably to relatively easy and know manufacturing techniques and production using known and available materials, and incorporates safety features that make it most desirable as a much needed and useful household accessory that will result in economic savings of both time and costly energy as well as in the economy of manufacture.

In short what has been invented and disclosed herein, is a much needed device, a useful device, a practical device, that will be easy and economic to construct, easy to install, certain and secure operation and relatively cheap to purchase, and which will save valuable time in eliminating unnecessary separate drying runs, and save valuable energy costs for the user, and production costs for the manufacturer.

The accompanying drawings illustrate preferred embodiments of the invention in which similar reference numerals refer to similar features in different views.

Figure 1:
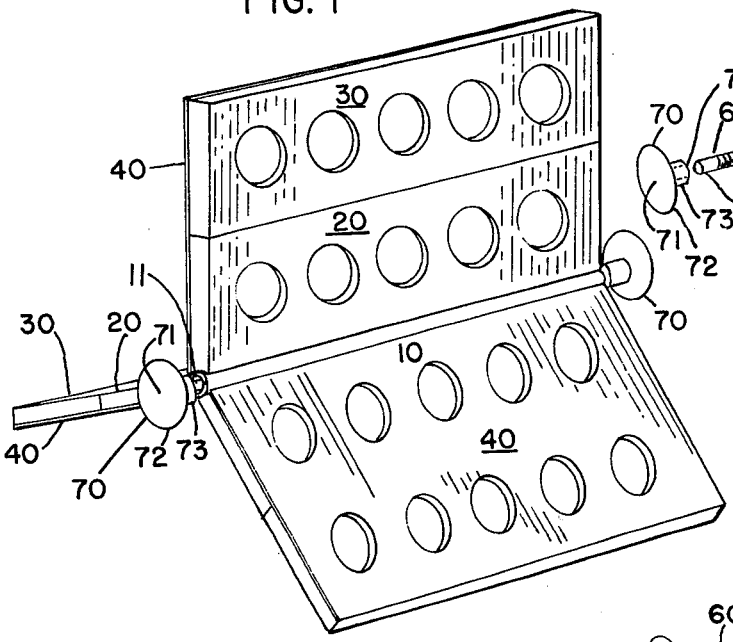
FIG. 1 is a perspective view of an entire three (3) compartment assembly in its open or operating position.
Figure 4:
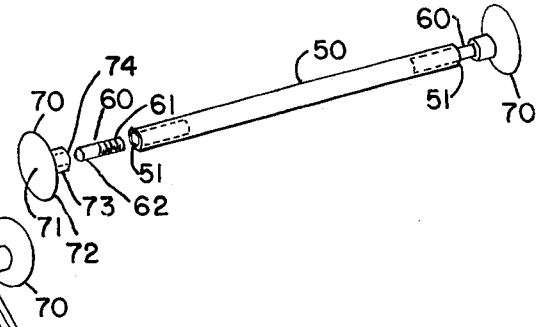
FIG. 4 is one embodiment of a centering rod with its adjustable suction cup pieces, with an exploded view of one of the adjustable suction cup end pieces.

Now referring to the accompanying drawings, the basic elements of the preferred embodiments of this invention consists of a central rotable core unit 10 provided with a cylindrical hollow opening 11 extending lengthwise though the entire center of the core unit 10. Extending outwardly from the core unit 10 and integral with it are a plurality of perforated lower fin dividers 20, ideally three (3) in number but not less than two (2) in number. A perforated upper fin divider 30 is connected to each lower fin divider 20 by a folding or hinging means 40, 41, 42 exemplified in the accompanying drawings FIGS. 1, 2, 3 and 6 and to be described in more detail separately in this description.

An elongated tubular centering rod 50 is inserted within the hollow opening 11 of the core unit 10 and this centering rod 50 is provided on each of its end portions with a threaded opening 51 to receive the threaded end portion 61 of a connecting bolt 60, which connecting bolt 60 adjustably connects the centering rod 50 to a suction cup piece 70 at both ends of the centering rod 50 by rotating or screwing the connecting bolt 60 in or out to adjust the distance between the two suction cup pieces 70.

The suction cup piece 70 consists essentially of the normal rubberized cup flexible face 71 with a circular periphery 72 and a base extention 73 provided with a hollow cylindrical opening 74 extending part way into the base extention 73. This base opening 74 is to slidably receive the preferrably smooth end portion 62 of connecting bolt 60, thus removably and slidably connecting the suction cup piece to the centering rod 50 at both ends of the centering rod 50 and permitting easy removal of the suction cup piece 70 from the connecting bolt 60 for safety as well as easy installation purposes.

In the preferred embodiment practically all normally used suction cups with a face diameter of from 1 to 2 inches performed adequately and well and would accomplish the results desired in this invention.

The centering rod 50 when disposed completely within the hollow opening 11 of the rotatable core unit 10 not only acts to connect the two suction cup pieces 70, but also acts as the bearing surface around which the rotatable core unit 10 rotates when in operation.

Figure 2:
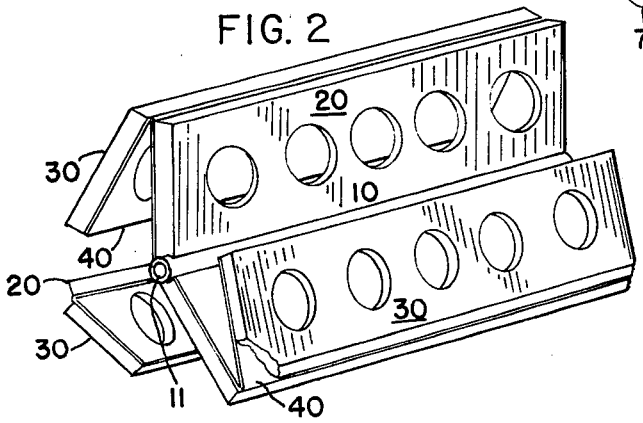
FIG. 2 is a perspective view of the dividers in their folded position and without the centering rod and adjustable suction cup pieces, and with a cut away fragmentary view of one corner of divider.

The lower and upper fin dividers 20 and 30 are foldably connected to each other as shown in FIGS. 1 and 2 by means of a perforated flexible and foldable sturdy sheet material 40 covering and bonded to the entire surface on one side of each of the pairs of lower and upper fin dividers 20 and 30 to permit folding of the upper fin 30 in one direction only.

Figure 6:
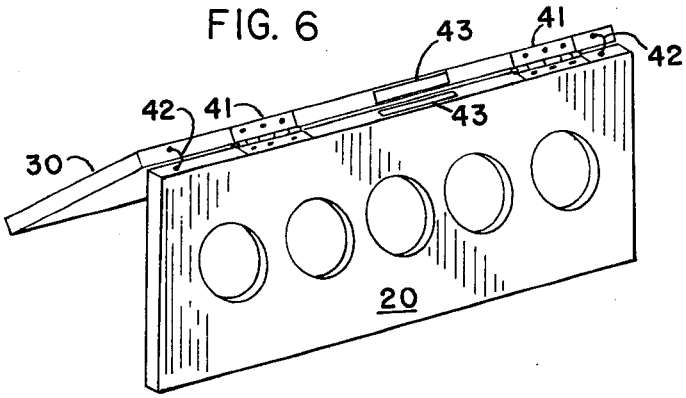
FIG. 6 is a sectional perspective view of one embodiment of an upper and lower section of a folded or hinged position.

FIG. 6 demonstrates another means for folding the lower and upper fin dividers 20 and 30, as by hinges 41 or an elastic band 42 or both. Also in FIG. 6 is shown a pair of magnetic pieces 43 attached to each of the lower and upper fin dividers edges so as to act as a possible locking device to securely hold the lower and upper fin dividers 20 and 30 together when in their open or operating position. There, of course, are other means of accomplishing the folding or hinging means to connect the fin dividers 20 and 30 within the purview of this invention not mentioned herein. Further, there are additional locking means besides the mentioned magnets 43 to secure the lower and upper fin dividers 20 and 30 in place and in a common plane when in their open or operating position as shown in FIGS. 1 and 3, that may be incorporated when felt desireable or necessary and still remain within the purview of this invention.

Figure 5:
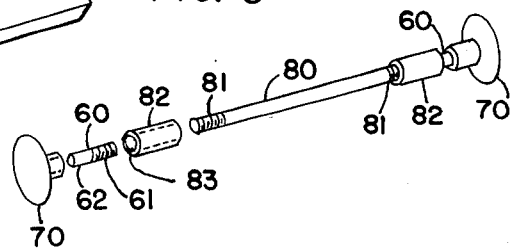
FIG. 5 is another embodiment of a centering rod with its adjustable suction cup pieces on each end, with an exploded view of one of the adjustable suction pieces including an adjustable coupling.

FIG. 5 shows a perspective view of a second version of the adjustable suction cup piece 70 and its adjustable connecting means. In this instance a preferred embodiment consists of a centering rod 80 provided with threaded end portions 81 to receive a threaded coupling 82. The threaded coupling 82 is threaded throughout so as to screw on to the threaded end portion 81 of the centering rod 80 and receive the threaded end portion 61 of connecting bolt 60 which in turn is slidable connected to the suction cup piece 70 at its other end.

Figure 3:
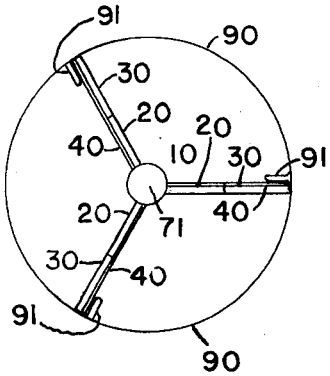
FIG. 3 is a front elevation cut away view showing an entire three (3) compartment assembly in its open and operating position within a typical drier drum.

FIG. 3 is a cut away front view of the entire assembly in its open and operating position within a typical drier drum 90 normally found in household use. In this view the upper fin divider sections 30 are resting against the normally provided interior flanges 91 of drier drums such a way so as to take advantage of the flanges presence in rotating the entire fin divider assembly in the normal clockwise rotation of the drier drum 90 when the drum 90 is rotating and in operation.

The overall dimensions of the fin dividers 20 and 30 are determined by the interior dimensions of the drier drum 90 in particular use. Ideally the fin dividers 20 and 30 should substantially fill a plane within the drum interior as shown in FIG. 3 extending from the core unit 10 to the drier drum surface 90. The contact of the fin divider 30 with the drum 90 is sufficient to cause rotation of the dividers 20 and 30, however, the drum flanges 91 are also available to insure such rotation of the fin dividers 20 and 30.

FIG. 1 shows the complete assembly in its open position with the suction cup pieces 70 in place at both ends of the centering rod 50. FIG. 3 shows the complete assembly in place within the drier drum 90. Keeping these two views in mind it becomes obvious how simply the installation of the complete assembly can be accomplished by the means of the two suction cup pieces 70 on each end of the center rod 50. Once all of the upper fin dividers 30 are opened or unfolded the suction cup pieces 70 are automatically centered within the drier drum as shown in FIG. 3. The rear suction cup piece 70 will be pushed against the stationary rear center portion of a drier drum and suction hold the assembly in place. The front suction cup piece 70 will be adjusted by screwing into or out of the centering rod 50 to establish the desired suction pressure contact with the interior of the drier door when the door is closed, thus securing by means of both suction cup pieces 70 the centering rod 50 and rotable fin divider assembly to the center of the stationary interior of the drier opposite the door on one end and the center of the drier door interior on the other end.

By the incorporation of the suction cups pieces 70 the ease for securing the assembly before and during operation becomes obvious. The use of suction cups has additional advantages in that they also act as substantial shock absorbers in preventing possible damage or injury to the drier door or drier interior. The suction cup piece 70 through the adjusting connecting bolt 60 can lengthen or shorten the distance between both suction cups 70 to establish the desired distance between suction cups 70 to permit proper suction cup holding action on the door interior when closed. It is anticipated that the proper adjusting technique will be to adjust the distance between both suction cup pieces 70 until the drier door can close easily, however when opening the drier door the suction cup piece 70 in contact with the door remains on the door and is slidably removed from its connecting bolt 60 when the door is open. This then assures that both suction cup pieces 70 are performing their important suction securing function when the drier door is closed and the unit is in operation. An additional safety and desireable feature to consider is to construct the connecting centering rods 50 or 80 in such a way as to be slightly flexible instead of rigid so as to have some give when the two suction cup pieces are pressed with the closing of the drier door, thus permitting a slightly wider range of flexibility of the divider assembly in meeting a wider range of drier drum interior designs.

The material that can be used to form the fin dividers 20 and 30 as well as the rotable core unit 10 can be constructed from any preferably light weight non-absorbing material that can be perforated to permit the free flow of air through it and strong enough to maintain and secure the lower and upper fin dividers 20 and 30 in their open position substantially in one plane when in operation.

The novel and useful drier fin divider assembly described herein, which can be folded to insert into the normal household drier, opened within the drier drum to provide a plurality of divided compartments, adjustable with removable suction cup pieces to center and hold the assembly in place during operation, is not only a new, novel and useful invention, but is a relatively quick and easy as well as economical and practical way to accomplish with safety and certainty a much needed desired and useful function in most households.

Having described the present invention and its preferred embodiments herein what is now claimed is:

1. A removable drying apparatus for use in a rotary drum dryer comprising:

a rotatable core unit, said core unit having a cylindrical opening extending lengthwise through the center of said core unit;

a plurality of perforated lower fin dividers integral with and extending outwardly from said core unit;

a perforated upper fin divider foldably connected to each of said lower fin dividers;

a centering rod disposed within said cylindrical opening of said core unit around which said core unit will rotate, said centering rod being provided with a threaded opening in the center of each end portion of said tubular centering rod;

a pair of suction cup pieces, each consisting of a flexible suction cup face portion and a suction cup base portion integral with and opposite of said suction cup face portion, and said suction cup base portion being provided with a cylindrical opening extending part way into the center of said suction cup base portion perpendicular to the plane of said flexible suction cup face outer periphery;

a pair of adjusting connecting bolts, each threaded on one end portion and substantially smooth on its other end portion to connect each of said suction cup pieces one to each end of said centering piece; the threaded end portion being provided for adjustably screwing into each of the said threaded openings on said center rod, and the smooth end portion for slidably fitting snuggly into the said cylindrical opening in said suction cup base portion.

2. A removable drying apparatus as set forth in claim 1 with the inclusion of an adjustable threaded coupling screwed on each end portion of said elongated tubular centering piece to receive the said threaded end portion on the said adjusting connecting bolt, and said adjustable threaded coupling outer surface being the bearing surface around which the said core unit will rotate.

3. A removable drying apparatus as set forth in claim 1 with the foldable means being a perforated flexible sheet material securely attached to both the lower and upper fin dividers on one side only, thus permitting folding in one direction only.

4. A removable drying apparatus as set forth in claim 1 with the foldable means being a hinge connection connecting the lower and upper fin dividers and permitting folding of the upper fin divider in one direction only.

5. A removable drying apparatus as set forth in claim 3 with a securing means for securely holding the lower and upper fin dividers in the same plane when in their open and unfolded operating position within the drier.

6. A removable drying apparatus as set forth in claim 5 with the securing means being provided by a magnetic piece attached to the top edge of the lower fin divider and the corresponding bottom edge of the upper fin divider, so as to hold the lower and upper fin dividers in the same plane when in their open or unfolded position.

7. A removable drying apparatus as set forth in claim 4 with a securing means for securely holding the lower and upper fin dividers in the same plane when in their open and unfolded operating position within the drier.

8. A removable drying apparatus as set forth in claim 7 with the securing means being provided by a pair of magnets one attached to the upper edge of said lower fin divider and one correspondingly attached to the lower edge of said upper fin divider.

9. A removable drying apparatus as set forth in claim 1 with said centering rod being slightly flexible and not rigid.

10. A removable drying apparatus as set forth in claim 2 with said centering rod being slightly flexible and not rigid.

* * * * *